US006955329B1

(12) United States Patent
Shieh

(10) Patent No.: US 6,955,329 B1
(45) Date of Patent: Oct. 18, 2005

(54) SUPPORT DEVICE FOR MIRROR, PICTURE OR THE LIKE

(76) Inventor: Ming Chun Shieh, P.O. Box 63-99, Taichung (TW) 406

( * ) Notice: Subject to any disclaimer, the term of this patent is extended or adjusted under 35 U.S.C. 154(b) by 12 days.

(21) Appl. No.: 10/867,547

(22) Filed: Jun. 11, 2004

(51) Int. Cl.[7] ..... A47F 1/14
(52) U.S. Cl. ..... 248/466; 248/475.1; 359/871
(58) Field of Search ..... 248/466, 475.1, 248/469, 470, 471, 472, 476; 359/871

(56) References Cited

U.S. PATENT DOCUMENTS

| | | | | |
|---|---|---|---|---|
| 1,448,024 | A | 3/1923 | Brizgis | 248/476 |
| 4,339,104 | A | 7/1982 | Weidman | 248/407 |
| 4,657,361 | A * | 4/1987 | Eitel et al. | 248/562 |
| 6,398,378 | B1 * | 6/2002 | Shieh | 359/879 |
| 6,402,330 | B1 * | 6/2002 | Scheidegg | 359/879 |
| 6,412,964 | B2 * | 7/2002 | Hattori et al. | 359/879 |

FOREIGN PATENT DOCUMENTS

| | | | | |
|---|---|---|---|---|
| FR | 2654183 | * | 5/1991 | 248/466 |

* cited by examiner

*Primary Examiner*—Ramon O Ramirez
(74) *Attorney, Agent, or Firm*—Alan D. Kamrath; Nikolai & Mersereau, P.A.

(57) ABSTRACT

A support device includes a head, a lock nut threaded to the head and having a peripheral flange, and a control ferrule having a peripheral rib engaged with the peripheral flange of the lock nut, to rotatably attach the control ferrule to the head with the lock nut. A coupler includes a shank, and an arm secured to the shank and attached to a frame device, a rod is extended from the shank and engageable through the lock nut and into the head. One or more fasteners may secure the shank to the frame device. The shank is threaded to the control ferrule, to secure the shank and the frame device to the head, and the fastener is received and shielded within the control ferrule.

5 Claims, 4 Drawing Sheets

SUPPORT DEVICE FOR MIRROR, PICTURE OR THE LIKE

BACKGROUND OF THE INVENTION

1. Field of the Invention

The present invention relates to a support device, and more particularly to a support device for supporting mirrors, pictures, and the like.

2. Description of the Prior Art

Various kinds of typical support devices have been developed and provided for supporting mirrors, pictures, and the like, and normally comprise a support member for receiving the pictures, the mirror members or the like.

For example, U.S. Pat. No. 1,448,024 to Brizgis discloses one of the typical support devices for pictures or the like, and comprises a pivotal structure attached to a frame member, for inclienedly supporting the frame member on tables, or for attaching the frame member to walls.

However, the fastener members for attaching the pivot strut to the frame member may not be suitably shielded or blocked, and may thus be exposed, and may have a good chance to hurt the users or the like.

U.S. Pat. No. 4,339,104 to Weidman discloses another typical support or floor stand devices for mounting mirrors or the like, and comprises a U-shaped upstanding arm to support the frame member on ground.

However, similarly, the fastener members for attaching the upstanding arm to the support frame may not be suitably shielded or blocked, and may thus be exposed, and may have a good chance to hurt the users or the like. In addition, the mirror frame device may not be attached to walls.

The present invention has arisen to mitigate and/or obviate the afore-described disadvantages of the conventional frame devices.

SUMMARY OF THE INVENTION

The primary objective of the present invention is to provide a support device including a supporting structure for attaching or securing the support device to walls or the like, without exposing the fastener members.

In accordance with one aspect of the invention, there is provided a support device comprising a seat including a head having a bore and a screw hole formed therein and communicating with each other, a lock nut threaded to the screw hole of the head, and including a peripheral flange extended therefrom, and including an orifice formed therein, a control ferrule including a threaded hole formed therein, and including a peripheral rib extended therefrom, and engaged with the peripheral flange of the lock nut, to rotatably attach the control ferrule to the head with the lock nut, a frame device including at least one screw hole formed therein, a coupler including a shank, and an arm secured to the shank and having a space formed therein to receive the frame device, and the shank including an outer thread formed thereon and including a rod extended therefrom, the rod being engageable through the orifice of the lock nut, and engageable into the bore of the head, and at least one fastener engaged through the shank, and the outer thread of the shank being threaded with the screw hole of the frame device, to secure the shank to the frame device. The threaded hole of the control ferrule is engageable with the outer thread of the shank, to secure the shank and the frame device to the head, and the fastener is received and shielded and protected within the control ferrule, and may be prevented from being rusted.

The orifice of the lock nut is flush with the bore of the head, to suitably receive the rod of the shank. The seat includes a plate, a stem extended from the plate, and the head is formed on the stem. It is preferable that the frame device includes a mirror disposed therein.

The peripheral flange of the lock nut is extended radially and outwardly therefrom, and the peripheral rib of the control ferrule is extended radially and inwardly therefrom, and engaged with the peripheral flange of the lock nut, to rotatably secure the control ferrule to the head with the lock nut.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
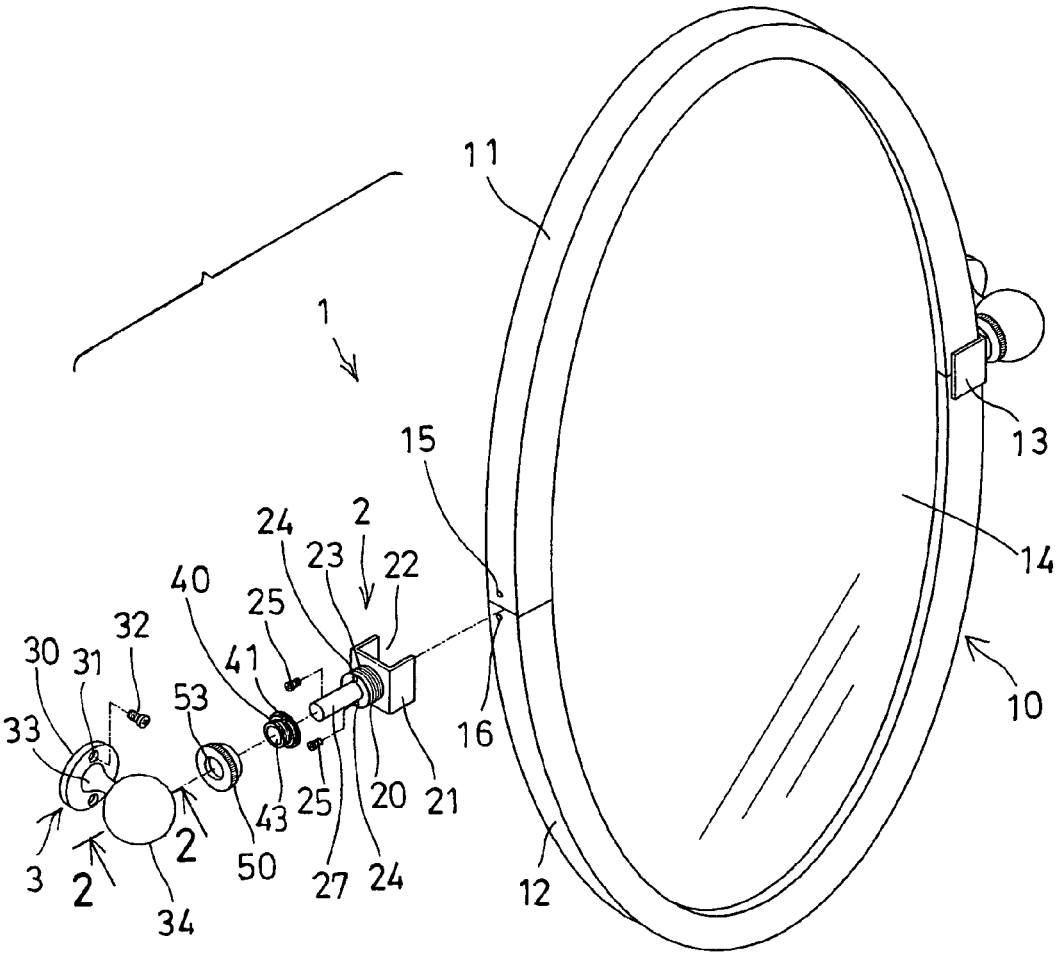
FIG. 1 is an exploded view of a support device in accordance with the present invention.
Figure 2:
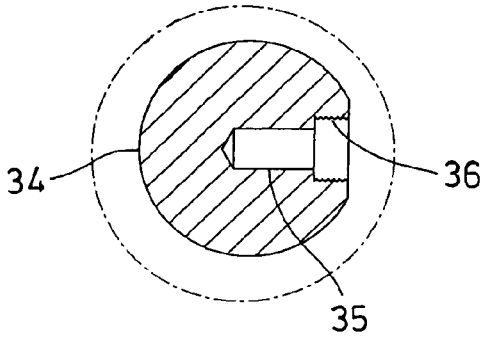
FIG. 2 is a cross sectional view taken along lines 2—2 of FIG. 1.
Figure 3:
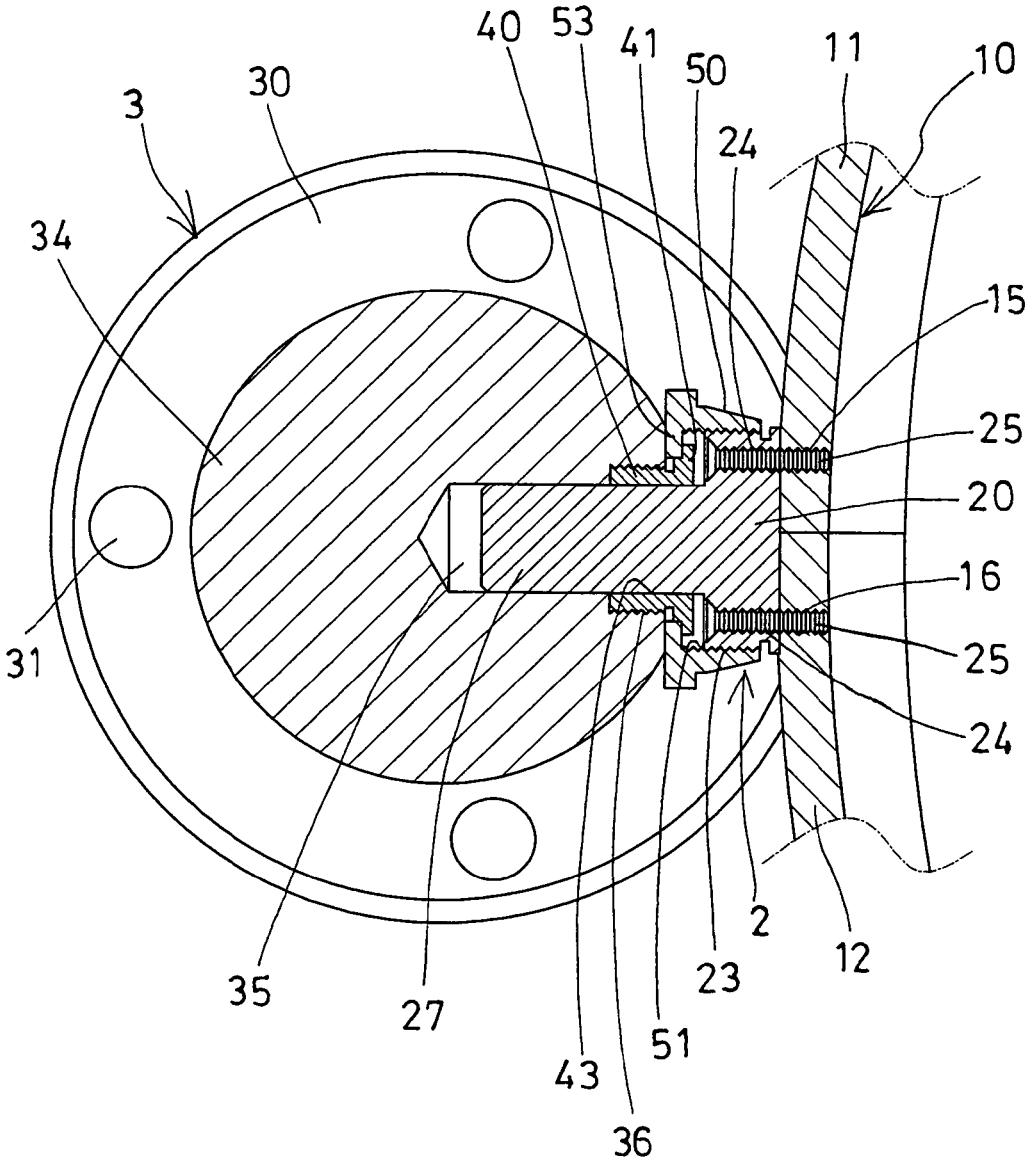
FIG. 3 is a cross sectional view of the support device.

Referring to the drawings, and initially to FIGS. 1–3, a support device 1 in accordance with the present invention comprises a frame device 10 which may include two frame members 11, 12 secured together with such as U-shaped brackets 13, to support a mirror 14, pictures (not shown) or the like therein. The frame device 10 may include one (FIGS. 4, 5) or more, such as two screw holes 15, 16 formed therein, such as formed in the frame members 11, 12 respectively (FIGS. 1, 3).

A coupler 2 includes a shank 20, a U-shaped arm 21 attached or secured onto the shank 20 and having a space 22 formed therein for receiving one side portion of the frame device 10, and preferably for shielding the screw holes 15, 16 of the frame device 10. The shank 20 includes an outer thread 23 formed thereon, and includes one or more, such as two holes 24 formed therein and preferably formed through the length of the shank 20, or formed through the shank 20, for receiving fasteners 25 which may be threaded with the screw holes 15, 16 of the frame device 10, to secure the shank 20 to the frame device 10. The shank 20 includes a rod 27 extended therefrom, preferably extended opposite to the arm 21.

A seat 3 includes a plate 30 having one or more holes 31 formed therein, for receiving fasteners 32 which may be threaded to other support members, such as walls (not shown). The seat 3 includes a stem 33 extended from the plate 30, and a head 34 formed or provided on the stem 33. The head 34 may be formed into various kinds of decorative shapes, and may include a bore 35 formed therein for receiving the rod 27 of the shank 20 or of the coupler 2, and an enlarged screw hole 36 formed in outer portion thereof and communicating with the bore 35 thereof (FIG. 3).

A lock nut 40 is threaded to the screw hole 36 of the head 34, and includes a peripheral flange 41 extended radially and outwardly therefrom, and includes an orifice 43 formed therein and flushing with the bore 35 of the head 34, for receiving the rod 27 of the shank 20 or of the coupler 2 (FIG. 3). A control ferrule 50 includes a threaded hole 51 formed therein (FIG. 3), and includes a peripheral rib 53 extended radially and inwardly therefrom, and engaged with the peripheral flange 41 of the lock nut 40, to rotatably attach or retain the control ferrule 50 to the head 34 with the lock nut 40.

As shown in FIG. 3, the threaded hole 51 of the control ferrule 50 may be threaded with the outer thread 23 of the shank 20, to lock or secure the shank 20 and thus the frame device 10 to the head 34 with the lock nut 40 and the control ferrule 50. The plate 30 of the seat 3 may then be secured or attached to the other support members, such as walls (not shown).

It is to be noted that the screw holes 15, 16 of the frame device 10 and the fasteners 25 may be shielded within the control ferrule 50, such that the frame device 10 may be secured or attached to the head 34 without exposing the fasteners 25. In addition, the rod 27 of the shank 20 and thus the frame device 10 may be rotated or adjusted relative to the head 34 of the seat 3 to any selected angular positions.

The lock nut 40 and the shank 20 and the fasteners 25 may thus be suitably received and shielded within the control ferrule 50, such that only the control ferrule 50 may be seen from outside of the support device, such that the support device may include a clean outer appearance. In addition, the lock nut 40 and the shank 20 and the fasteners 25 may also be suitably shielded and prevented from being rusted, such that the frame device 10 is particularly suitable for supporting the mirror 14 in bathrooms or the like.

Figure 4:
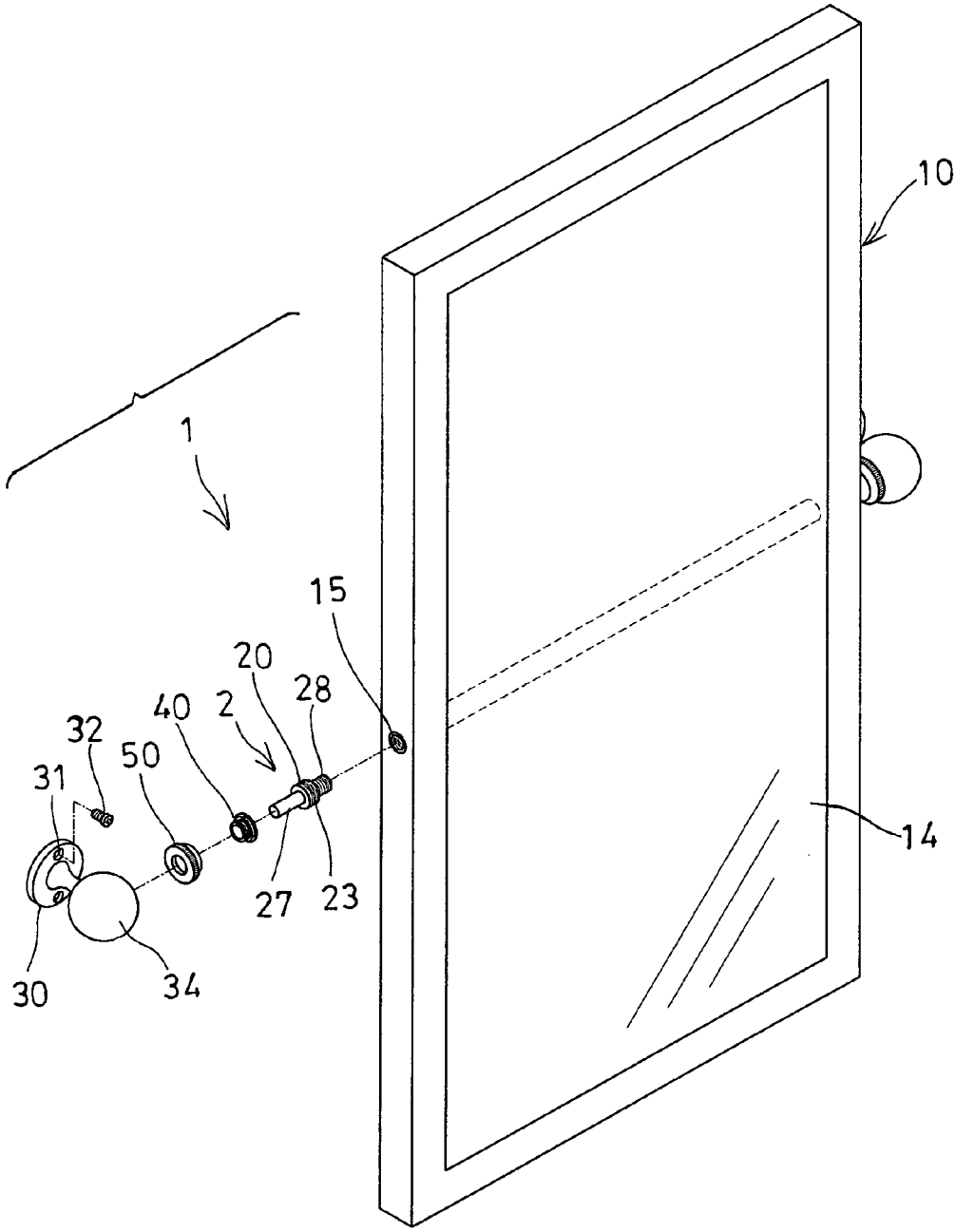
FIG. 4 is an exploded view similar to FIG. 1, illustrating the other arrangement of the support device.
Figure 5:
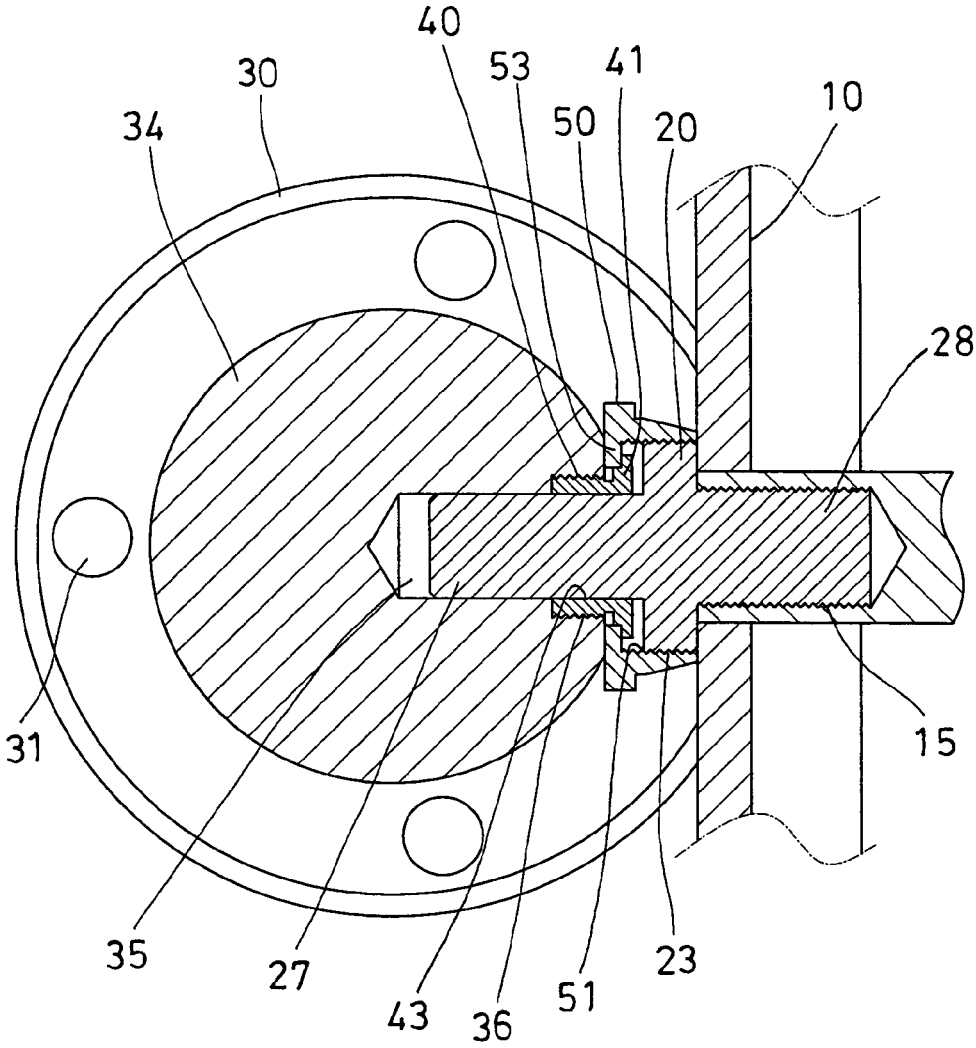
FIG. 5 is a cross sectional view of the support device as shown in FIG. 4.

Referring next to FIGS. 4 and 5, for the other frame devices 10 having different shapes or configurations, the coupler 2 may include a threaded pole 28 extended from the shank 20, and threaded to the screw hole 15 of the frame device 10. The screw hole 15 of the frame device 10 and the threaded pole 28 may also be shielded within the control ferrule 50, such that the frame device 10 may also be secured or attached to the head 34 without exposing the threaded pole 28. In addition, the rod 27 of the shank 20 and thus the frame device 10 may also be rotated or adjusted relative to the head 34 of the seat 3 to any selected angular positions.

Accordingly, the support device in accordance with the present invention includes a supporting structure for attaching or securing the support device to walls or the like, without exposing the fastener members.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A support device comprising:

a seat including a head having a bore and a screw hole formed therein and communicating with each other, a lock nut threaded to said screw hole of said head, and including a peripheral flange extended therefrom, and including an orifice formed therein, a control ferrule including a peripheral rib extended therefrom, and engaged with said peripheral flange of said lock nut, to rotatably attach said control ferrule to said head with said lock nut, and said control ferrule including a threaded hole formed therein, a frame device including at least one screw hole formed therein, a coupler including a shank, and an arm secured to said shank and having a space formed therein to receive said frame device, and said shank including an outer thread formed thereon and including a rod extended therefrom, said rod being engageable through said orifice of said lock nut, and engageable into said bore of said head, and at least one fastener engaged through said shank, and threaded with said at least one screw hole of said frame device, to secure said shank to said frame device, and said threaded hole of said control ferrule being engageable with said outer thread of said shank, to secure said shank and said frame device to said head, and said at least one fastener being received and shielded within said control ferrule.

2. The support device as claimed in claim 1, wherein said orifice of said lock nut is flush with said bore of said head, to receive said rod of said shank.

3. The support device as claimed in claim 1, wherein said peripheral flange of said lock nut is extended radially and outwardly therefrom, and said peripheral rib of said control ferrule is extended radially and inwardly therefrom, and engaged with said peripheral flange of said lock nut, to rotatably secure said control ferrule to said head with said lock nut.

4. The support device as claimed in claim 1, wherein said seat includes a plate, a stem extended from said plate, and said head is formed on said stem.

5. The support device as claimed in claim 1, wherein said frame device includes a mirror disposed therein.

* * * * *